US009816733B2

(12) United States Patent
Haley et al.

(10) Patent No.: US 9,816,733 B2
(45) Date of Patent: Nov. 14, 2017

(54) ECONOMIZER INJECTION ASSEMBLY AND METHOD

(71) Applicant: TRANE INTERNATIONAL INC., Piscataway, NJ (US)

(72) Inventors: Paul Francis Haley, Coon Valley, WI (US); Rick Todd James, La Crescent, MN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 209 days.

(21) Appl. No.: 14/655,356

(22) PCT Filed: Dec. 31, 2013

(86) PCT No.: PCT/US2013/078507

§ 371 (c)(1),
(2) Date: Jun. 25, 2015

(87) PCT Pub. No.: WO2014/106252

PCT Pub. Date: Jul. 3, 2014

(65) Prior Publication Data

US 2015/0345833 A1 Dec. 3, 2015

Related U.S. Application Data

(60) Provisional application No. 61/747,459, filed on Dec. 31, 2012.

(51) Int. Cl.
*F25B 7/00* (2006.01)
*F25B 1/10* (2006.01)
(Continued)

(52) U.S. Cl.
CPC ..... *F25B 7/00* (2013.01); *F04D 27/0207* (2013.01); *F04D 29/441* (2013.01);
(Continued)

(58) Field of Classification Search
CPC ..... F25B 7/00; F25B 1/04; F04D 29/5846; F04D 27/0207; F04D 29/441
See application file for complete search history.

(56) References Cited

U.S. PATENT DOCUMENTS 2,277,647 A 3/1942 Jones
3,232,074 A * 2/1966 Weller ..... F25B 1/10 62/117

(Continued)

FOREIGN PATENT DOCUMENTS

| | | |
|---|---|---|
| CN | 101825087 | 9/2010 |
| JP | 2009257704 | 11/2009 |
| JP | 2010091135 | 4/2010 |

OTHER PUBLICATIONS

International search report for International application No. PCT/US2013/078507, dated Mar. 25, 2014 (3 pages).

(Continued)

*Primary Examiner* — Emmanuel Duke
(74) *Attorney, Agent, or Firm* — Hamre, Schumann, Mueller & Larson, P.C.

(57) ABSTRACT

Embodiments provided herein are directed to systems and methods of re-injecting vaporized flash refrigerant from an economizer into a two-stage compressor. The injection can be through an injection port positioned after the first compression stage. The location of the injection may have a relatively low static refrigerant pressure. The injection port and/or an injection pipe of the economizer may be configured to pre-condition the vaporized flash refrigerant so that a flow velocity and/or direction of the vaporized flash refrigerant flow can be match a flow velocity and/or direction of the refrigerant in the refrigerant conduit.

16 Claims, 5 Drawing Sheets

(51) Int. Cl.

| | |
|---|---|
| ***F04D 27/02*** | (2006.01) |
| ***F04D 29/44*** | (2006.01) |
| ***F04D 29/58*** | (2006.01) |
| *F25B 1/04* | (2006.01) |

(52) U.S. Cl.
CPC ..... *F04D 29/5846* (2013.01); *F25B 1/10* (2013.01); *F25B 1/04* (2013.01); *F25B 2400/13* (2013.01)

(56) References Cited

U.S. PATENT DOCUMENTS

| | | | | |
|---|---|---|---|---|
| 3,741,676 | A | 6/1973 | Silvern et al. | |
| 4,171,623 | A | 10/1979 | Lavigne, Jr. et al. | |
| 4,232,533 | A | 11/1980 | Lundblad et al. | |
| 4,475,354 | A | 10/1984 | Akerhielm et al. | |
| 5,499,509 | A | 3/1996 | Harold et al. | |
| 5,575,157 | A | 11/1996 | Harold | |
| 6,065,297 | A * | 5/2000 | Tischer | F04D 29/063 62/471 |
| 6,272,869 | B1 | 8/2001 | Eber | |
| 7,069,741 | B2 | 7/2006 | Sishtla | |
| 7,975,506 | B2 | 7/2011 | James et al. | |
| 8,020,402 | B2 | 9/2011 | Pham et al. | |
| 2007/0134084 | A1 | 6/2007 | Zausner | |
| 2009/0004029 | A1 | 1/2009 | Wegner et al. | |
| 2009/0205361 | A1 | 8/2009 | James et al. | |
| 2009/0208331 | A1 * | 8/2009 | Haley | F04D 29/4213 415/191 |
| 2009/0229280 | A1 | 9/2009 | Doty et al. | |

OTHER PUBLICATIONS

Written opinion for International application No. PCT/US2013/078507, dated Mar. 24, 2014 (8 pages).

* cited by examiner

ECONOMIZER INJECTION ASSEMBLY AND METHOD

FIELD

The disclosure herein generally relates to a heating, ventilation, and air-conditioning ("HVAC") system, such as a chiller system, that has a centrifugal compressor with two or more stages of compression. More particularly, methods, systems, and apparatuses described herein are directed to injecting vaporized flash refrigerant from the economizer into the centrifugal compressor with two or more stages of compression.

BACKGROUND

A HVAC system can include a chiller, which typically includes a compressor, an evaporator, and a condenser forming a refrigeration loop. Typically, the compressor is configured to compress a refrigerant vapor; the condenser is configured to condense the compressed refrigerant vapor to a liquid refrigerant; and the evaporator is configured to utilize the liquid refrigerant to cool a process fluid, such as water. In some embodiments, the compressor may be configured to have two or more compression stages.

Some HVAC systems may include an economizer, which is typically positioned between the condenser and the evaporator in the refrigerant loop. The economizer may improve an operational efficiency of the HVAC system by flash cooling the liquid refrigerant from the condenser to a temperature that may be lower than the temperature of the liquid refrigerant leaving the condenser. It is known in the art that the economizer may vaporize a portion of the liquid refrigerant from the condenser (also known as flash refrigerant) to provide flash cooling. The vaporized flash refrigerant from the economizer may be directed back to the compressor for compression.

SUMMARY

Embodiments are provided to re-inject vaporized flash refrigerant, such as from an economizer of a chiller, such as may be included in a HVAC system, into a compressor for compression. The compressor of the chiller may include a first compression stage and a second compression stage, and the first compression stage and the second compression stage may be fluidly connected by a refrigerant conduit. The vaporized flash refrigerant from the economizer may be injected at an injection port that is located on the refrigerant conduit after the first compression stage, and mixed with compressed refrigerant from the first compression stage before flowing into the second compression stage. Embodiments as disclosed herein may help reduce/minimize mixing losses, such as for example reduce/minimize a pressure drop when the vaporized flash refrigerant and the compressed refrigerant from the first compression stage mix in the refrigerant conduit. Embodiments as disclosed herein may also help increase efficiency of the compressor of the chiller.

In some embodiments, the vaporized flash refrigerant may be injected at a location with a relatively low static refrigerant pressure. In some embodiments, the vaporized flash refrigerant can be injected between the first compression stage and the second compression stage, and the injection can be performed close to the first compression stage, such as close to the exit of the compressed refrigerant from the first compression stage, and where the static pressure of the refrigerant is typically relatively low, compared to other locations between the first compression stage and the second compression stage. In some embodiments, the location with a relatively low static refrigerant pressure may be along a refrigerant conduit connecting the first compression stage and the second compression stage. In some embodiments, the refrigerant conduit of the HVAC system may include a run-around pipe in fluid communication with a discharge exit of the first compression stage and an inlet of the second compression stage. In some embodiment, the location of the rejection can be close to the discharge exit of the refrigerant conduit.

In some embodiments, the run-around pipe may be configured to have a gradually increasing diameter (or cross-section size). In some embodiments, the vaporized flash refrigerant can be injected close to the beginning of the run-around pipe where the diameter (or cross-section size) of the run-around pipe is relatively small compared to other locations of the run-around pipe.

In some embodiments, the injection port may be located at a lower quarter circle of the refrigerant conduit, relative to an "up" direction that is defined by an axis that is vertical to the ground.

In some embodiments, the injection port may be configured to include an internal surface feature that is configured to condition the vaporized flash refrigerant from the economizer to flow and swirl in directions that are similar to the flow and swirl directions of the compressed refrigerant from the first compression stage in the refrigerant conduit. In some embodiments, the internal surface feature of the injection port may be configured to bend toward a direction that is similar to (or matches) the flow and/or swirl direction of the compressed refrigerant in the refrigerant conduit.

In some embodiments, an injection pipe may be configured to fluidly connect the injection port to the source of vaporized flash refrigerant, which may be for example an economizer, and to form fluid communication with the source of vaporized flash refrigerant and the injection port. The injection pipe has a diameter (or cross-section size). In some embodiments, the diameter (or cross-section size) may be configured so that a flow velocity of the vaporized flash refrigerant in the injection pipe is similar to (or matches) a flow velocity of the compressed refrigerant from the first compression stage in the refrigerant conduit.

In some embodiments, the HVAC system may include a swirl control device positioned inside the refrigerant conduit before the inlet of the second compression stage. The swirl control device can be configured to reduce swirling in the refrigerant flow in the refrigerant conduit.

In some embodiments, a method of injecting refrigerant vapor between a first compression stage and a second compression stage of a compressor in a HVAC system may include: injecting the refrigerant vapor at an injection port of a refrigerant conduit fluidly connecting the first compression stage and the second compression stage, where at the injection port, a static pressure of compressed refrigerant in the refrigerant conduit is relatively low compared to other locations along the refrigerant conduit; and pre-conditioning the injected refrigerant vapor, so that a flow velocity of the injected refrigerant vapor is about the same as a flow velocity of the compressed refrigerant in the refrigerant conduit at the injection port.

In some embodiments, the method may further include: pre-conditioning the injected refrigerant vapor, so that a composite flow direction of the injected refrigerant vapor is about the same as a composite flow direction of the compressed refrigerant at the injection port in the refrigerant conduit.

Other features and aspects of the fluid management approaches will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

Figure 1:
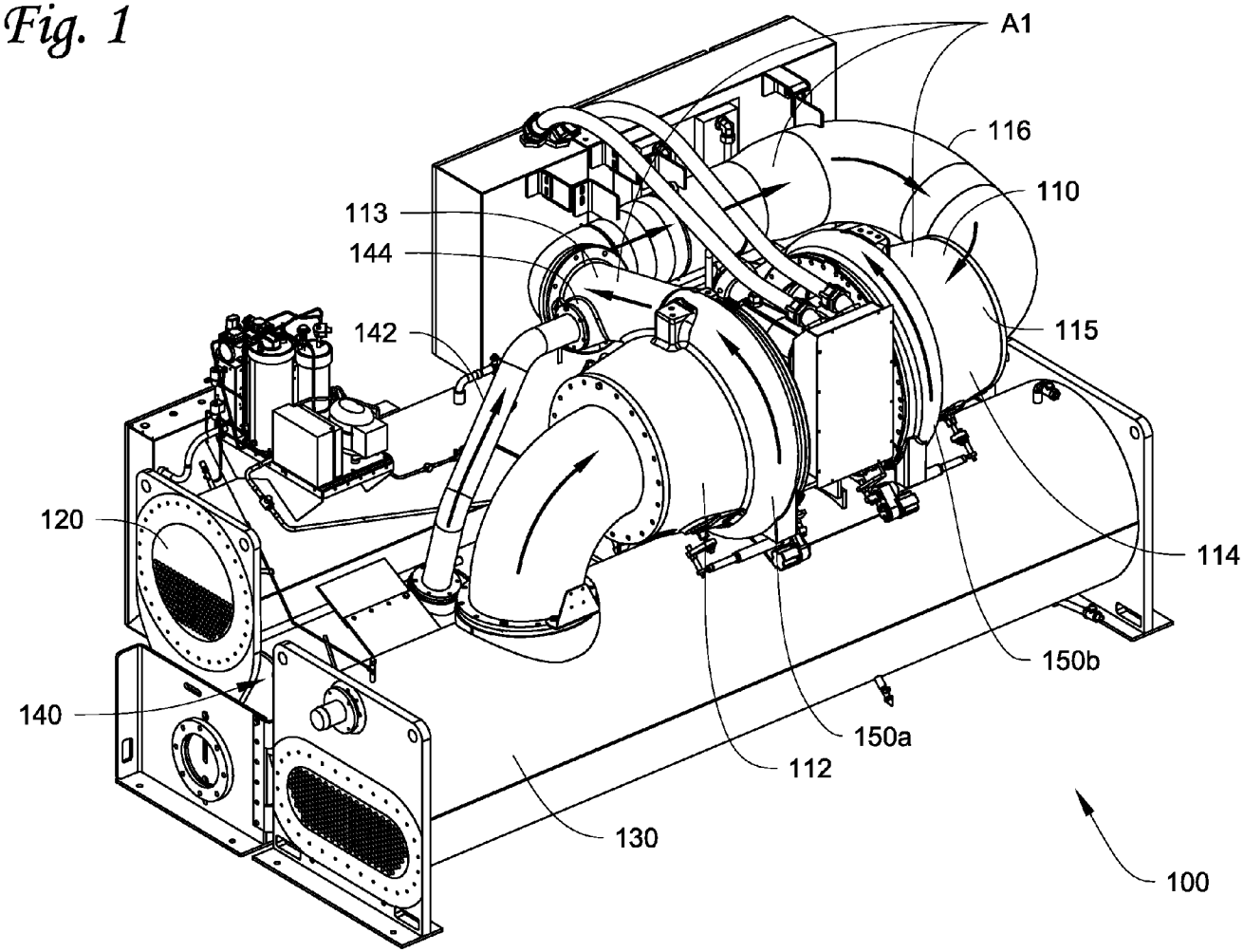
FIG. 1 is a perspective view of a chiller with an economizer, according to one embodiment.

A chiller typically includes a compressor, a condenser, an evaporator forming a refrigeration loop. In some embodiments, the chiller may include an economizer that is typically configured to reduce a temperature of a liquid refrigerant condensed in the condenser by flash cooling the liquid refrigerant before the liquid refrigerant flowing to the evaporator. Flash refrigerant utilized by the economizer may be vaporized during the flash cooling process, and the vaporized flash refrigerant may be re-injected to the compressor for compression. Flash refrigerant can also be utilized to cool, for example, a motor of the chiller.

Some compressors may be configured to include two or more compression stages. When the compressor has two or more compression stages, the vaporized flash refrigerant may be injected after the first compression stage, so as to by-pass the first compression stage. The injected vaporized flash refrigerant can, for example, be mixed with compressed refrigerant vapor from the first compression stage, and be directed to the second compression stage for compression. Injecting the vaporized flash refrigerant from the economizer after the first compression stage may save energy of the compressor and increase efficiency of the HVAC system.

The compressor can be a centrifugal compressor, a scroll compressor, a screw compressor, or other suitable types. Typically, the compressor includes a moving part, such as an impeller in a centrifugal compressor that can be configured to compress the refrigerant vapor. The compression of the refrigerant vapor by the compressor can result in a refrigerant flow. For example, in a centrifugal compressor, the impeller rotates around an axis to eject the refrigerant vapor in a radial direction relative to the axis. The compressed refrigerant vapor ejected from the impeller can be collected by a volute surrounding the impeller. The compressed refrigerant vapor collected by the volute can form a compressed refrigerant flow along the volute. In some embodiments, the refrigerant vapor can also swirl in the volute when the compressed refrigerant vapor flows along the volute.

When the refrigerant vapor, for example from the economizer, is injected after the first compression stage, because the injected refrigerant vapor may not flow and/or swirl in the same directions and/or velocities as the compressed refrigerant vapor flowing in the volute, the mixing of the injected refrigerant vapor and the compressed refrigerant vapor may cause mixing losses such as for example a pressure drop, which is not desirable for the performance of the chiller. Mixing losses may also include a loss of flow velocity of the refrigerant flow, and/or introducing turbulence in the refrigerant flow. Improvements can be made to reduce and/or minimize mixing losses, such as the pressure drop, when the injected refrigerant vapor and the compressed refrigerant vapor mix.

Embodiments disclosed herein can typically work in a chiller, a refrigeration system or other suitable systems with a compressor that has two or more compression stages. Embodiments described herein are directed to systems and methods of re-injecting vaporized flash refrigerant from a source such as an economizer into the compressor through an injection port located after the first compression stage along a refrigerant conduit fluidly connecting the first compression stage and the second compression stage of the compressor. In some embodiments, the injection port may be located at a position that has a relatively low static refrigerant pressure along the refrigerant conduit, such as close to a discharge exit of the first compression stage. In some embodiments, the injection port and/or an injection pipe may be configured to pre-condition the vaporized flash refrigerant, e.g. from the economizer, so that a flow velocity and/or a direction of the vaporized flash refrigerant flow can be matched with a flow velocity and/or a direction of a compressed refrigerant flow from the first compression stage, for example before the vaporized flash refrigerant and the compressed refrigerant mix. Embodiments as disclosed herein may help reduce and/or avoid mixing losses, such as for example a pressure drop when the injected vaporized flash refrigerant, e.g. from the economizer, and the compressed refrigerant from the first compression stage mix; and help increase efficiency of the HVAC system.

In some embodiments, the mixed refrigerant may be conditioned by a swirling control device before the mixed refrigerant enters the second compression stage. The swirling control device may help reduce incidence mismatch when the mixed refrigerant enters the second compression stage.

Figure 4:
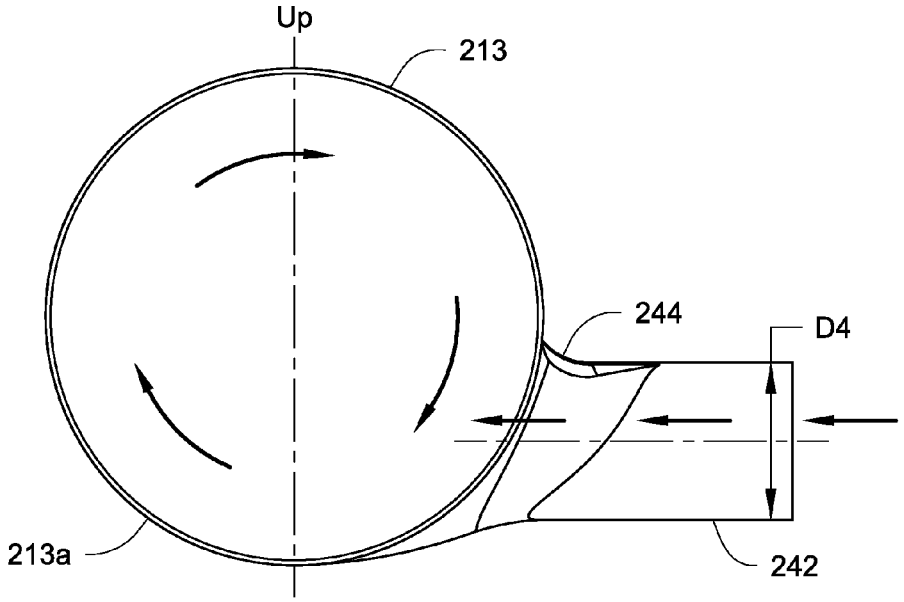
FIG. 4 is a front view of the discharge exit of the chiller as shown in FIG. 2.

References are made to the accompanying drawings that form a part hereof, and in which is shown by way of illustration of the embodiments in which the embodiments may be practiced. Arrows in figures generally indicate a flow direction of refrigerant in operation. The flow direction is generally in accordance with refrigerant passages of the chiller, such as along a refrigerant conduit, a discharge exit of a first compression stage, or an inlet of the second compression stage. It is to be noted that the refrigerant can also swirl as illustrated in FIG. 4 relative to the flow direction of the refrigerant, when the refrigerant vapor flows along the refrigerant passages. It is to be understood that the terms used herein are for the purpose of describing the figures and embodiments and should not be regarded as limiting the scope of the present application.

FIG. 1 illustrates an embodiment of a chiller 100, such as for a HVAC system. The chiller 100 includes a compressor 110 that is configured to have a first compression stage 112 and a second compression stage 114. The compressor 110 can be a centrifugal compressor. The first compression stage 112 and the second compression stage 114 include a first volute 150*a* and a second volute 150*b* respectively. The chiller 100 also includes a condenser 120, an evaporator 130 and an economizer 140. A run-around pipe 116 is configured to fluidly connect the first compression stage 112 to the second compression stage 114 to form fluid communication between the first compression stage 112 and the second compression stage 114.

The run-around pipe 116 is fluidly connected to a discharge exit 113 of the first compression stage 112 and an inlet 115 of the second compression stage 114. The discharge exit 113 is in fluid communication with the first volute 150*a*. The run-around pipe 116, the discharge exit 113 and the inlet 115 form a refrigerant conduit A1, which is configured to direct a refrigerant flow.

The economizer 140 is configured to have an injection pipe 142 forming fluid communication with the refrigerant conduit A1 through an injection port 144. The injection pipe 142 is configured to direct vaporized flash refrigerant from the economizer 140 to the injection port 144.

Refrigerant flow directions when the chiller 100 is in operation are generally illustrated by the arrows. The refrigerant flow directions are typically in accordance with refrigerant passages, such as defined by the refrigerant conduit A1 and the first and second volutes 150*a*, 150*b*.

In operation, refrigerant vapor from the evaporator 130 can be directed into the first compression stage 112. A first impeller (not shown in FIG. 1, but such as the impeller 219*a* in FIG. 2) located in the first compression stage 112 can compress the refrigerant vapor from, for example, the evaporator 130. The compressed refrigerant vapor can be collected by the volute 150*a* and directed into the refrigerant conduit A1. The compressed refrigerant is directed into the inlet 115 of the second compression stage 114 via the refrigerant conduit A1. In the second compression stage 114, a second impeller (not shown in FIG. 1, but such as the impeller 219*b* in FIG. 2) can be configured to further compress the refrigerant and then direct the compressed refrigerant into, for example, the condenser 120 through the second volute 150*b*. In the condenser 120, the compressed refrigerant may be condensed into liquid refrigerant. The liquid refrigerant leaving the condenser 120 is then typically directed into the evaporator 130.

The economizer 140 is generally positioned between the condenser 120 and the evaporator 130. The economizer 140 can be configured to vaporize a portion of the liquid refrigerant (flash refrigerant), for example, from the condenser 120, to provide flash cooling to the liquid refrigerant leaving the condenser 120. Flash cooling the liquid refrigerant leaving the condenser can help further cool the liquid refrigerant to a temperature that is below the temperature of the liquid refrigerant when leaving the condenser 120. The vaporized flash refrigerant can be directed into the injection pipe 142 and can be injected through the injection port 144 into the refrigerant conduit A1 between the first compression stage 112 and the second compression stage 114. The injection of the vaporized flash refrigerant can help the flash refrigerant from the economizer 140 by-pass the compression by the first compression stage 112. The vaporized flash refrigerant can be mixed with the compressed refrigerant vapor exiting from the first compression stage 112 in the refrigerant conduit A1, and the mixed refrigerant can be directed into the second compression stage 114 through the refrigerant A1 for further compression. Injecting the vaporized flash refrigerant between the first compression stage 112 and the second compression stage 114 may save energy and/or increase efficiency of the chiller 100 by eliminating recompressing the vaporized flash refrigerant from the economizer 140 in the first compression stage 112.

It is generally known in the art that a static pressure of the refrigerant has an inverse relationship with a flow velocity of the refrigerant. The flow velocity of the refrigerant is typically relatively high and the static pressure of the refrigerant is typically relatively low in the volutes 150*a* and 150*b*. The flow velocity of the refrigerant is also typically relatively high and the static pressure of the refrigerant is typically relatively low close to the discharge exit 113 of the first compression stage 112.

Figure 2:
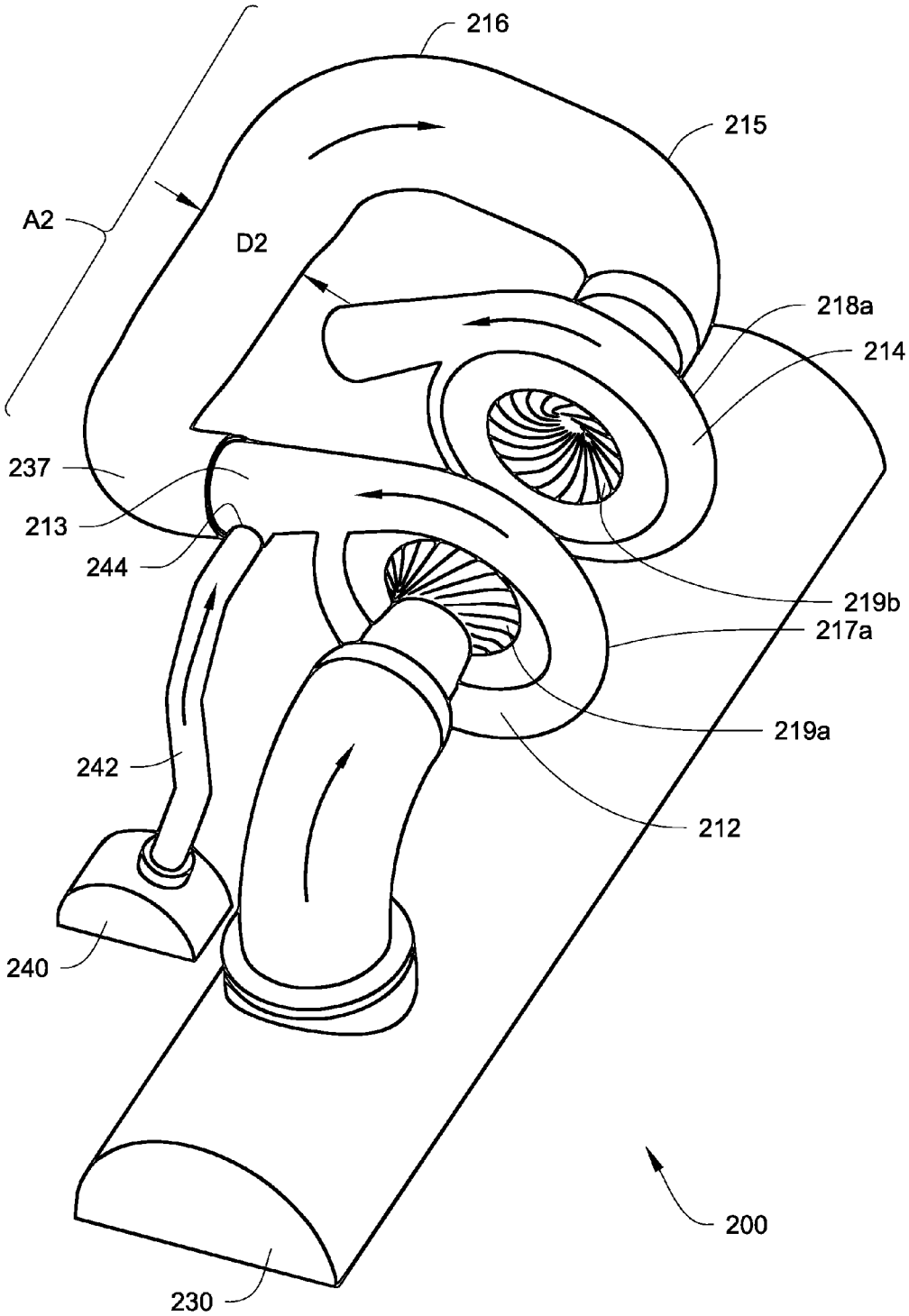
FIG. 2 is a perspective view of a portion of another embodiment of a chiller.

Referring to FIG. 2, a portion of a chiller 200, including an evaporator 230, a first compression stage 212, a second compression stage 214, a run-around pipe 216 and an economizer 240, is shown.

The first compression stage 212 and the second compression stage 214 are configured to have volutes 217*a* and 218*a* respectively. The volutes 217*a* and 218*a* are configured to receive refrigerant compressed by impellers 219*a* and 219*b* respectively. The first compression stage 212 has a discharge exit 213 extending from the volute 217*a* of the first compression stage 212. Relative to the volute 217*a*, the discharge exit 213 extends in a direction that is about tangent to the volute 217*a*.

As illustrated, the run-around pipe 216 forms a fluid communication with the discharge exit 213 of the first compression stage 212 and an inlet 215 of the second compression stage 214. The fluid communication of the discharge exit 213, the run-around pipe 216 and the inlet 215 defines a refrigerant conduit A2. The run-around pipe 216 has a section with a diameter (or cross-section size) D2. The diameter (or cross-section size) D2 can be configured to gradually increase from the discharge exit 213 of the first compression stage 212 and the inlet 215 of the second compression stage 214.

The economizer 240 is in fluid communication with the refrigerant conduit A2 through the injection pipe 242 and an injection port 244. As illustrated, the injection port 244 is typically closer to the first compression stage 212 than the second compression stage 214.

As illustrated, the refrigerant conduit A2 can make a plurality of turns between the first compression stage 212 and the section compression stage 214. The injection port 244 is typically located before the first turn of the refrigerant conduit A2 from the first compression stage 212 and the second compression stage 214.

In operation, the impeller 219*a* of the first compression stage 212 compresses refrigerant vapor from the evaporator 230. The compressed refrigerant vapor is collected by the volute 217*a* and directed into the run-around pipe 216 through the discharge exit 213. The run-around pipe 216 then directs the compressed refrigerant vapor toward the second compression stage 214.

In some embodiments, since a section of the run-around pipe 216 can have an increasing diameter (or cross-section size) D2 from the first compression stage 212 to the second compression stage 214, a flow velocity and a pressure of the compressed refrigerant vapor can vary along the run-around pipe 216. Typically, the flow velocity of the compressed refrigerant vapor reduces while a static pressure of the compressed refrigerant vapor increases when the diameter (or cross-section size) D2 increases in the run-around pipe 216 from the first compression stage 212 to the second compression stage 214. In the embodiment shown in FIG. 2, at the discharge exit 213 or at a beginning portion 237 of the run-around pipe 216 before the section with the increasing diameter (or cross-section size) D2, the flow velocity of the compressed refrigerant vapor is relatively high, and the static pressure of the refrigerant vapor is relatively low.

The terms "relatively high" and "relatively low" in this documents generally mean "more likely to be high" and "more likely to be low" respectively in a comparison between the referred locations (such as at the injection port 244 in FIG. 2) to other locations of the refrigerant conduit (such as the refrigerant conduit A2 in FIG. 2). The terms "relatively high" and "relatively low" also include the highest and the lowest values in the refrigerant conduit.

The injection port 244 is configured to be positioned at a location along the refrigerant conduit A2 that has a relatively low static refrigerant pressure along the refrigerant conduit A2, such as close to the discharge exit 213 or in the run-around pipe 216 before the section with increasing diameter (or cross-section size) D2. The flow velocity of the refrigerant flow in the refrigerant conduit A2 is relatively high in these locations, and the static refrigerant pressure is relatively low, compared to other locations of the refrigerant conduit A2.

It is to be appreciated that the embodiment as illustrated in FIG. 2 is exemplary. The injection port 244 may be located at other locations, preferably at a location that has a relatively low static refrigerant pressure along the refrigerant conduit A2. For example, the flow velocity of the refrigerant is typically the highest and the static refrigerant pressure is typically the lowest in a volute of the compression stage (e.g. the volute 150*a* of the first compression stage 112 in FIG. 1). It may be also beneficial to inject, for example, the vaporized flash refrigerant from the economizer (e.g. the economizer 240) to the volute of the first compressor stage.

It is to be appreciated that the refrigerant conduit A2 may be configured to have other configurations. For example, the diameter (or cross-section size) of the refrigerant conduit A2 may increase and/or decrease between the first compression stage and the second compression stage. The location of the relatively low static refrigerant pressure may be affected by the design of the refrigerant conduit A2. In some embodiments, the location of the relatively low static refrigerant pressure may be in a middle section of the refrigerant conduit A2. In some embodiments, the location of the injection port 244 may be determined, for example, based on computer simulation results.

It is appreciated that the injection of the flash refrigerant may be injected at other locations, such as, for example, after the second compression stage 214. In some other embodiments, when more than two compression stages are used, the injection of the flash refrigerant can happen before any of the compression stages or after the final compression stage. The locations of the injection port can be changed accordingly. It is also appreciated that the source(s) of the flash refrigerant is not limited to the economizer. The flash refrigerant can be also, for example, from refrigerant used for motor cooling.

In the embodiment shown in FIG. 2, vaporized flash refrigerant from the economizer 240 can be injected into the refrigerant conduit A2 via the injection port 244 and mixed with a flow of the compressed refrigerant vapor discharged from the first compression stage 212. Injecting the vaporized flash refrigerant from the economizer 240 at a position with a relatively low static refrigerant pressure along the refrigerant conduit A2, such as the discharge exit 213, may help reduce/minimize mixing loses, such as for example a pressure drop, during the injection/mixing of the vaporized flash refrigerant. Injecting the vaporized flash refrigerant at the position with a relatively low static refrigerant pressure can also help increase an amount of the refrigerant injected through the injection port 244.

As illustrated in FIG. 2, relative to the first compression stage 212, the injection pipe 242 may be preferably configured to reach the refrigerant conduit A2 from a side that is different from the second compression stage 214. This may help in the assembly/servicing of the chiller 200, because the refrigerant conduit A2 may be easier to reach from the side that is different from the second compression stage 214 relative to the first compression stage 212, due to a relatively open space from the side compared to a space between the compression stages 212 and 214. However, it is understood that injection port 244 can be configured to approach the refrigerant conduit A2 from other directions.

Figure 3:
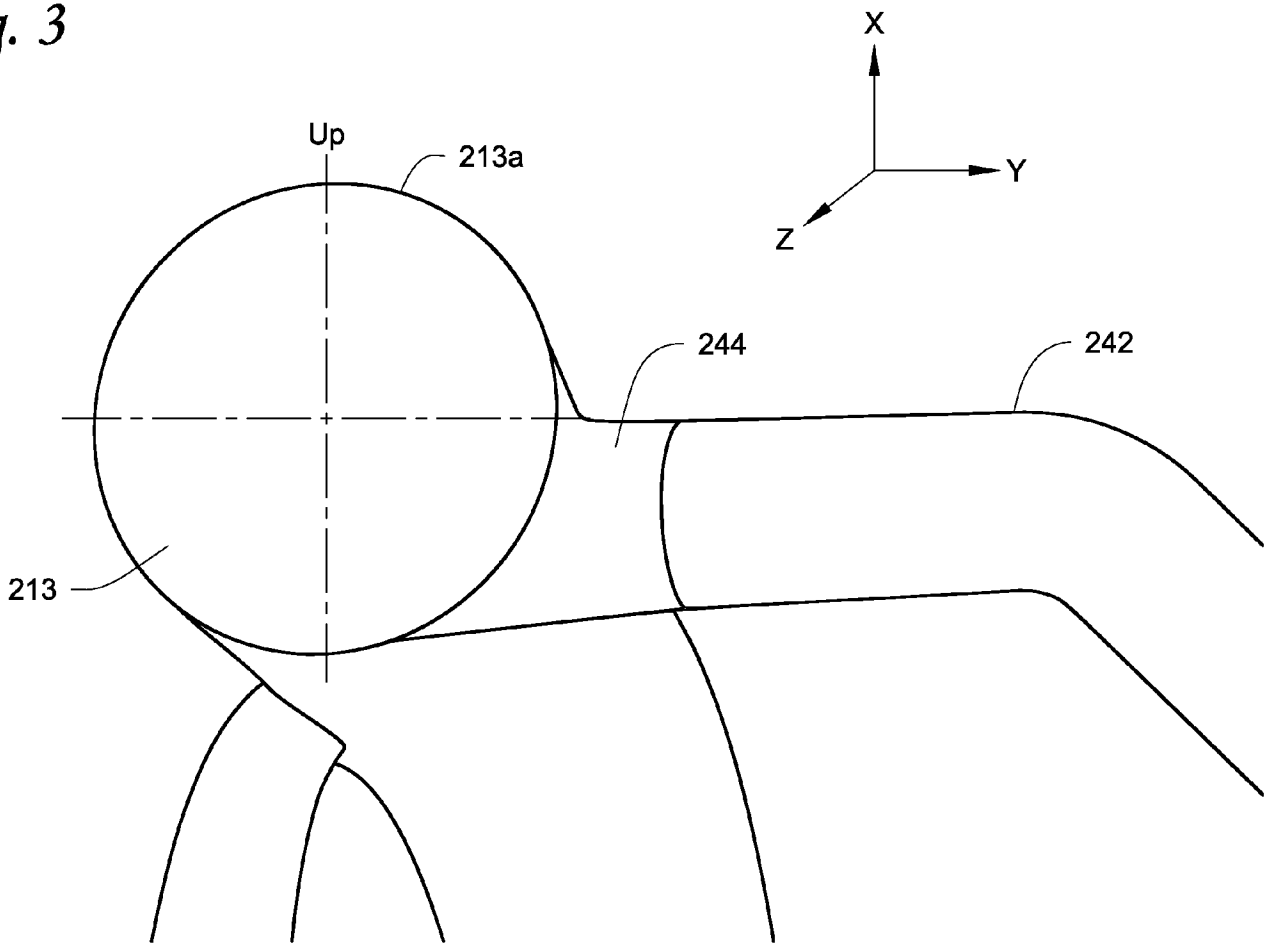
FIG. 3 is a front perspective view of a discharge exit of a first compression stage of the chiller as shown in FIG. 2.

Referring to FIG. 3, an enlarged view for the discharge exit 213 and the injection port 244 is shown. In one embodiment, an x axis of FIG. 3 is an axis that is vertical to the ground and defines an "up" direction. The ground is defined by y and z axes.

The discharge exit 213 can have a generally circular cross-section 213*a*. In the embodiment shown in FIG. 3, the injection port 244 fluidly connects the injection pipe 242 to the discharge exit 213 at a relatively lower part of the circular cross-section of the discharge exit 213 relative to the "up" direction defined by the x axis, such as a lower quarter circle of the discharge exit 213 as shown. Injecting the vaporized flash refrigerant from the lower quarter circle may help mix the injected vaporized flash refrigerant with the compressed refrigerant from the first compression stage 112, and may help reduce a pressure drop during the injection/mixing.

Referring to FIG. 4, a front view of the discharge exit 213, including the discharge exit 213, the injection port 244 and a portion of the injection pipe 242, is shown. The compressed refrigerant flowing in the discharge exit 213 not only can flow in the direction as shown by arrows in FIG. 2, but also can swirl (as shown by the circular arrows in FIG. 4) when the compressed refrigerant flows between the first compression stage 212 and the second compression stage 214. As illustrated, the compressed refrigerant flowing in the discharge exit 213 may swirl, for example, in a clock-wise direction. In the embodiment shown, the injection port 244 is located at the lower quarter circle of the circular cross section 213*a* relative to the "up" direction. It is noted that the swirl direction may be affected by designs of the first compression stage 212. In some embodiments, the swirl direction may be counter-clockwise The vaporized flash refrigerant is injected into the discharge exit 213 from the injection pipe 242. Because the location of the injection port 244 is located at the lower quarter circle of the cross-section 213*a* relative to the "up" direction, a flow direction of the injected vaporized flash refrigerant in the plane as shown in FIG. 4 (as indicated by the straight arrows in FIG. 4) is generally the same as (or aligned with) the clock-wise swirl direction of the compressed refrigerant at the injection port 244. This may help the two streams of refrigerant (compressed refrigerant vapor and the vaporized flash refrigerant) mix, and may help reduce mixing losses, such as for example a pressure drop during the injection/mixing of the two streams of refrigerant.

It is to be understood that in some other embodiments, the swirl direction may be counter-clockwise in the front view as shown in FIG. 4. In those embodiments, the injection port 244 may be positioned at the upper quarter circle of the cross section 213*a*. The general principle is that the injection port is positioned at a location where the injected vaporized flash refrigerant may flow in a direction that is about the same as (or match) the swirl direction of the compressed refrigerant at the location of the injection.

The injection pipe 242 has a diameter (or cross-section size) D4. Generally, a larger diameter (or cross-section size) D4 may result in a slower flow velocity of the injected vaporized flash refrigerant; conversely a smaller diameter (or cross-section size) D4 may result in a faster flow velocity of the injected vaporized flash refrigerant. By varying the diameter (or cross-section size) D4 of the injection pipe 242, a desired flow velocity of the injected vaporized flash refrigerant may be achieved. The injection pipe 242 therefore can be configured to pre-condition the vaporized flash refrigerant before the mixing of the vaporized flash refrigerant and the compressed refrigerant. The term "pre-condition" generally means utilizing, for example, the diameter (or cross-section size) D4 of the injection pipe 242 and/or internal surface feature(s) 570 of the injection port 544 as illustrated in FIG. 5, to change a flow and/or swirl direction and/or flow velocity of a refrigerant flow.

In some embodiments, the diameter (or cross-section size) D4 of the injection pipe 242 may be configured so that the flow velocity of the injected vaporized flash refrigerant at the injection port 244 is about the same as a flow velocity of the compressed refrigerant at the injection port 244. The flow velocity of the compressed refrigerant and/or the injected vaporized flash refrigerant may be a composite flow velocity that includes both a flow velocity of the refrigerant flow (e.g. shown by the straight arrows in FIG. 1) and the flow velocity of the swirling as shown in FIG. 4. When the flow velocity of the injected vaporized flash refrigerant and the flow velocity of the compressed refrigerant are about the same (or in alignment), the mixing of the two streams of the refrigerant may result in a relatively small pressure drop.

Figure 5:
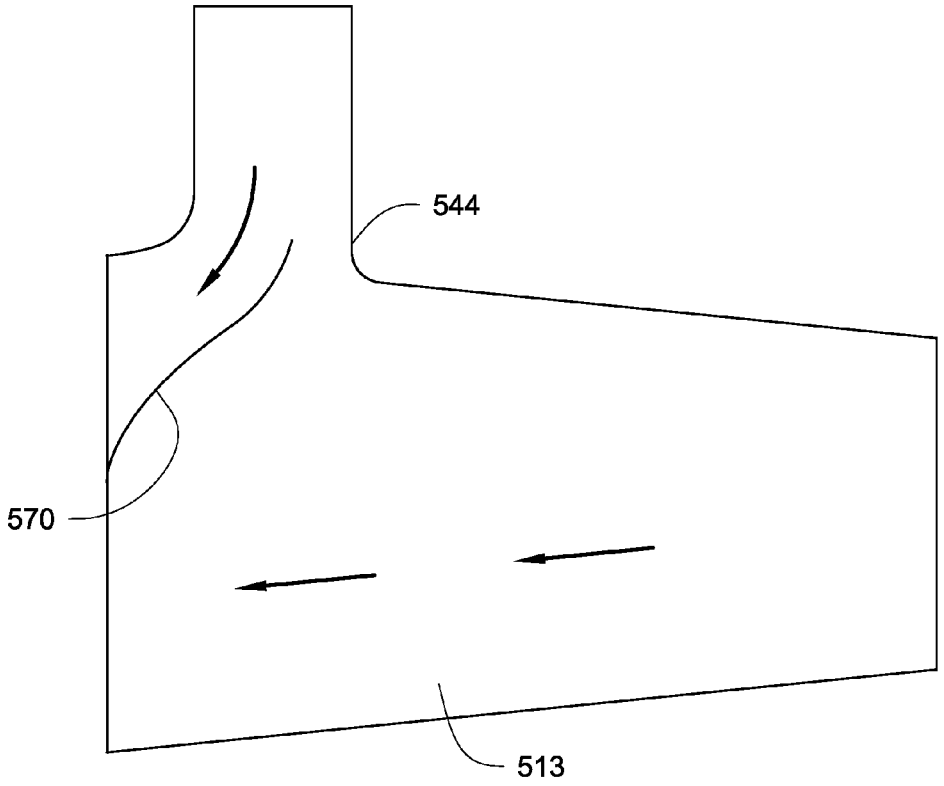
FIG. 5 is a cross-section view of a discharge exit of a chiller, according to another embodiment.

Referring to FIG. 5, a cross section of an embodiment of an injection port 544 is shown. As shown in FIG. 5, the injection port 544 is in fluid communication with a discharge exit 513.

The injection port 544 is configured to carry, for example, vaporized flash refrigerant, for example, from an economizer (e.g. the economizer 240 in FIG. 2). The discharge exit 513 is configured to carry, for example, compressed refrigerant from a first compression stage (e.g. the first compression stage 212 in FIG. 2). The injection port 544 may include an internal surface feature(s) 570 to pre-condition the vaporized flash refrigerant.

As illustrated in FIG. 5, the internal surface feature(s) 570 includes a smooth curve(s) that is angular relative to the flow direction of the compressed refrigerant. The smooth curve(s) may form a flow conduit to guide the vaporized flash refrigerant to turn into the flow direction of the compressed refrigerant flowing in the discharge exit 513.

The compressed refrigerant may have a general flow direction and a swirl direction. The actual flow direction of the compressed refrigerant may be the composite direction of the general flow direction and the swirl direction. The smooth curve(s), e.g. the internal surface feature(s) 570, can be configured to direct (or pre-condition) the flash refrigerant relative to a flow direction that is similar to the actual flow direction of the compressed refrigerant close to the injection port 544. The actual flow direction of the compressed refrigerant may be, for example, simulated by a computer.

In some embodiments, the internal surface feature(s) 570 can also be configured to cause the vaporized flash refrigerant to swirl in a direction that is similar to the swirl direction of the compressed refrigerant flowing in the discharge exit 513 (e.g. the swirl direction as shown in FIG. 4). The geometries of the surface feature(s) 570 may be optimized, for example, by computer simulation.

By pre-conditioning the vaporized flash refrigerant before the streams of vaporized flash refrigerant and the compressed refrigerant mix, the vaporized flash refrigerant may be conditioned to flow and/or swirl in a similar direction and/or flow velocity as the compressed refrigerant. The flow velocity and/or direction can be a composite flow velocity and/or direction including both the general flow velocity and/or direction illustrated for example by the straight arrows in FIG. 1 and the swirl velocity and/or direction illustrated for example in FIG. 4. Pre-conditioning the vaporized flash refrigerant may help reduce a pressure drop when the streams of the vaporized flash refrigerant and the compressed refrigerant mix.

Figure 6:
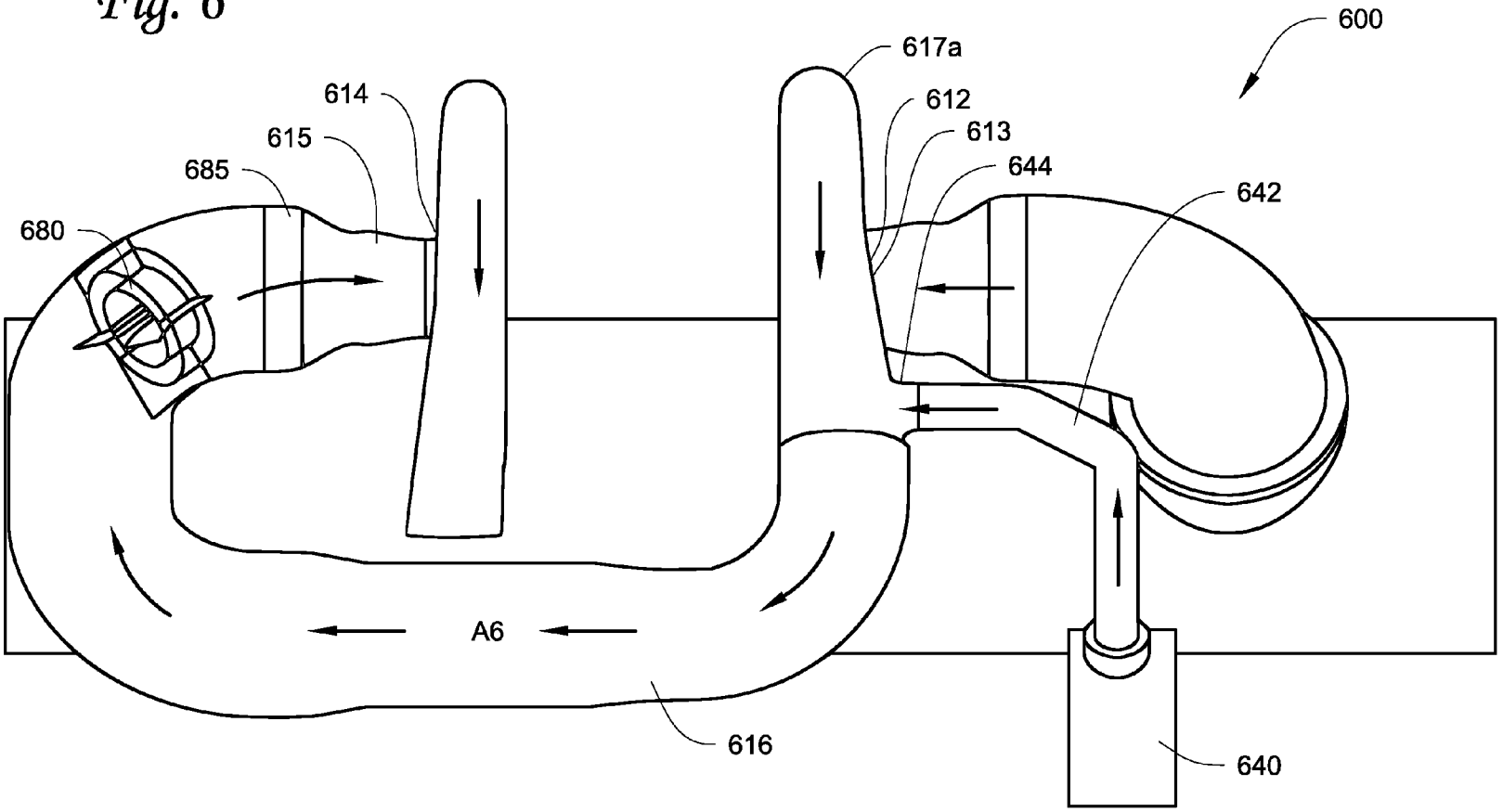
FIG. 6 is a perspective view of a portion of a chiller, according to yet another embodiment.

FIG. 6 illustrates a portion of another chiller 600, including an economizer 640, a volute 617*a* for a first compression stage 612, a discharge exit 613 of the volute 617*a*, a run-around pipe 616, and an inlet 615 of a second compression stage 614. The run-around pipe 616 is in fluid communication with the discharge exit 613 and an inlet 615 of the second compression stage 614. The discharge exit 613, the run-around pipe 616 and the inlet 615 of the second compression stage 614 define a refrigerant flow conduit A6.

The economizer 640 is in fluid communication with the refrigerant flow conduit A6 through an injection pipe 642 to the injection port 644, which may be configured as in FIG. 5 above.

A swirl control device 680 is positioned at about an end 685 of the run-around pipe 616 before the inlet 615 of the second compression stage 614. The swirl control device 680 may be configured to reduce the swirling in the refrigerant flowing along the refrigerant conduit A6 before the refrigerant enters the inlet 615, resulting in a substantial axial refrigerant flow into the second compression stage 614. The substantial axial refrigerant flow may help reduce incidence mismatch when the refrigerant flows into the inlet 615 of the second compression stage 614. One example of a swirl control device 680 is disclosed in the United States patent application publication No.: 2009/0208331A1.

It is to be appreciated that the embodiments as disclosed herein are exemplary. The embodiments disclosed herein are generally related to re-inject vaporized flash refrigerant from a source, such as an economizer, into a compressor of a chiller, for example in a chiller with multiple compression stages. In general, in a chiller with multiple compression stages, the vaporized flash refrigerant from the economizer may be re-injected so as to by-pass the first compression stage (for example at a discharge exit of the first compression stage) to save energy; and the injected vaporized flash refrigerant may be mixed with the compressed refrigerant from the first compression stage. The vaporized flash refrigerant may be injected at a location that has a relatively low static refrigerant pressure. A size of an injection pipe may be configured so that a flow velocity of the injected vaporized flash refrigerant may be similar to a flow velocity of the compressed refrigerant at the location of the injection. An injection port of the vaporized flash refrigerant may be configured to pre-condition the vaporized flash refrigerant so that flow and swirl directions and/or velocities of the injected vaporized flash refrigerant may be similar (or match) to flow and swirl directions and/or velocities of the compressed refrigerant. The configurations of the injection pipe and/or the injection port may help reduce a pressure drop when the vaporized flash refrigerant is mixed with the compressed refrigerant. In some embodiments, a swirl control device may be configured to reduce the swirling of the mixed refrigerant before the refrigerant flowing into the second compression stage.

It is to be appreciated that the embodiments and/or principles as disclosed here can also be adapted to work with chillers with a screw compressor, a scroll compressor, or other positive displacement compressors. Typically, the position of the refrigerant re-injection can be positioned at a position of the compressor corresponding to where the refrigerant has a relatively low pressure. In some embodiments, the refrigerant injection port can be positioned at an intermediate location in an one-stage compressor. For example, in a screw compressor, the refrigerant can be injected at an intermediate location along a lobe of the screw between an intake port and a discharge port. In a scroll compressor, the refrigerant can be injected at an intermediate location along a spiral vane between an intake port and a discharge port.

It is to be appreciated that the methods and systems as disclosed herein may also be adapted for injecting refrigerant vapor from other sources, such as flash refrigerant used to cool a motor or other components of the chiller.

Aspects

Any of aspects 1 to 10 can be combined with any of aspects 11-21. Any of aspects 11 to 15 can be combined with any of aspects 16 to 21. Any of aspects 16 to 18 can be combined with any aspects of 19 to 21.

Aspect 1. A chiller, comprising:

a condenser;

an evaporator;

a compressor including a first compression stage and a second compression stage;

a refrigerant conduit, the refrigerant conduit configured to be in a fluid communication with the first compression stage and the second compression stage; and an economizer, wherein the economizer is configured to form a fluid communication with the refrigerant conduit between the first and the second compressor stages and the fluid communication is formed closer to the first compression stage than the second compression stage.

Aspect 2. The chiller of aspect 1, further comprising an injection port on the refrigerant conduit, wherein the fluid communication is formed through the injection port, and the injection port is closer to the first compression stage than the second compression stage.

Aspect 3. The chiller of aspects 1-2, wherein the fluid communication is formed at a location along the refrigerant conduit with a relatively low static refrigerant pressure.

Aspect 4. The chiller of aspects 1-3, wherein the refrigerant conduit is defined by a discharge exit of the first compression stage, a run-around pipe and an inlet of the second compression stage, and the fluid communication is formed at the discharge exit of the first compression stage.

Aspect 5. The chiller of aspects 1-4, wherein the refrigerant conduit has a section with an increasing diameter from the first compression stage to the second compression stage, and the fluid communication is formed before the diameter starts to increase along the refrigerant conduit.

Aspect 6. The chiller of aspects 1-5, wherein the fluid communication is formed at a lower quarter of a cross section of the refrigerant conduit when viewing from a cross-section of the refrigerant conduit.

Aspect 7. The chiller of aspects 2-6, wherein the injection port has an internal surface feature that is configured to condition refrigerant from the economizer to flow in a direction that is similar to a flow direction of the refrigerant in the refrigerant conduit.

Aspect 8. The chiller of aspect 7, wherein the internal surface feature has a smooth turn that is configured to direct refrigerant into a refrigerant flow direction in the refrigerant conduit.

Aspect 9. The chiller of aspects 1-8, further comprising:

an injection pipe fluidly communicating with the refrigerant conduit and the economizer, wherein the injection pipe has a diameter that is configured to condition refrigerant from the economizer so that the refrigerant flows in a flow velocity that matches a refrigerant flow velocity in the refrigerant conduit.

Aspect 10. The chiller of aspects 1-9, further comprising:

a swirl control device; wherein the swirl control device is positioned inside the refrigerant conduit before the inlet of the second compression stage, and the swirl control device is configured to reduce refrigerant swirling in the refrigerant conduit.

Aspect 11. A chiller, comprising:

a condenser;

an evaporator;

a compressor including a first compression stage and a second compression stage;

a refrigerant conduit, the refrigerant conduit configured to be in fluid communication with the first compression stage and the second compression stage; and an injection port in fluid communication with the refrigerant conduit between the first and the second compressor stages;

wherein the injection port is configured to direct refrigerant into the refrigerant conduit and the injection port is positioned closer to the first compression stage than the second compression stage.

Aspect 12. The chiller of aspect 11, further comprising an economizer, wherein the injection port is in fluid communication with the economizer.

Aspect 13. The chiller of aspects 11-12, wherein the refrigerant conduit has a section with an increasing diameter from the first compression stage to the second compression stage, and the injection port is located before the diameter starts to increase along the refrigerant conduit.

Aspect 14. The chiller of aspects 11-13, wherein the injection port has an internal surface feature that is configured to condition refrigerant to flow in a direction that is similar to a flow direction of the refrigerant in the refrigerant conduit.

Aspect 15. The chiller of aspects 11-14, wherein the injection port connects to a lower quarter of a cross section of the refrigerant conduit when viewing from a cross-section of the refrigerant conduit.

Aspect 16. A compressor with a first compression stage and a second compression stage for a HVAC system, comprising:

a refrigerant conduit fluidly connecting the first compression stage and the second compression stage; and an injection port in fluid communication with the refrigerant conduit, wherein the fluid communication is formed closer to the first compression stage than the second compression stage.

Aspect 17. The compressor of aspect 16, wherein the refrigerant conduit has a section of an increasing diameter from the first compression stage to the second compression stage along the refrigerant conduit, and the injection port is positioned before the section of the increasing diameter.

Aspect 18. The compressor of aspects 16-17, further comprising a swirl control device; wherein the swirl control device is positioned inside the refrigerant conduit between the first and the second compression stages.

Aspect 19. A method of injecting refrigerant vapor between a first compression stage and a second compression stage of a compressor in a HVAC system, comprising:

directing the refrigerant vapor toward a refrigerant conduit fluidly connecting the first compression stage and the second compression stage; pre-conditioning the refrigerant vapor so that a flow direction of the refrigerant vapor matches a refrigerant flow direction in the refrigerant conduit;

directing the refrigerant vapor into the refrigerant conduit; and mixing the refrigerant vapor with the refrigerant compressed by the first compression stage.

Aspect 20. The method of aspect 19, further comprising:

pre-conditioning the injected refrigerant vapor so that a flow velocity of the refrigerant vapor matches a refrigerant flow velocity in the refrigerant conduit at the injection port.

Aspect 21. The method of aspects 19-20, further comprising:

reducing refrigerant swirling in the refrigerant conduit before the second compression stage.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What claimed is:

1. A chiller, comprising:

a condenser;

an evaporator;

a compressor including a first compression stage and a second compression stage;

a refrigerant conduit, the refrigerant conduit configured to be in fluid communication with the first compression stage and the second compression stage; and an economizer, wherein the economizer is configured to form a fluid communication with the refrigerant conduit between the first and the second compressor stages, the fluid communication is formed through an injection port, the injection port has an internal surface feature configured to inject refrigerant from the economizer into a refrigerant flow direction in the refrigerant conduit, the internal surface feature has a smooth curve configured to direct refrigerant to flow in a direction similar to the refrigerant flow direction in the refrigerant conduit, and the fluid communication is formed closer to the first compression stage than the second compression stage.

2. The chiller of claim 1, wherein the fluid communication is formed at a location along the refrigerant conduit with a relatively low static refrigerant pressure.

3. The chiller of claim 1, wherein the refrigerant conduit is defined by a discharge exit of the first compression stage, a run-around pipe and an inlet of the second compression stage, and the fluid communication is formed at the discharge exit of the first compression stage.

4. The chiller of claim 1, wherein the refrigerant conduit has a section with an increasing diameter from the first compression stage to the second compression stage, and the fluid communication is formed before the diameter starts to increase along the refrigerant conduit.

5. The chiller of claim 1, wherein the fluid communication is formed at a lower quarter of a cross section of the refrigerant conduit when viewing from a cross-section of the refrigerant conduit.

6. The chiller of claim 1, further comprising:

an injection pipe fluidly communicating with the refrigerant conduit and the economizer, wherein the injection pipe has a diameter that is configured to direct refrigerant from the economizer so that the refrigerant flows in a flow velocity that matches a refrigerant flow velocity in the refrigerant conduit.

7. The chiller of claim 1, further comprising:

a swirl control device, wherein the swirl control device is positioned inside the refrigerant conduit before the inlet of the second compression stage, and the swirl control device is configured to reduce refrigerant swirling in the refrigerant conduit.

8. A chiller, comprising:

a condenser;

an evaporator;

a compressor including a first compression stage and a second compression stage;

a refrigerant conduit, the refrigerant conduit configured to be in fluid communication with the first compression stage and the second compression stage; and an injection port in fluid communication with the refrigerant conduit between the first and the second compressor stages, wherein the injection port is configured to direct refrigerant into the refrigerant conduit, the injection port has an internal surface feature configured to direct refrigerant into a refrigerant flow direction in the refrigerant conduit, the internal surface feature has a smooth curve configured to direct refrigerant to flow in a direction similar to the refrigerant flow direction in the refrigerant conduit, and the injection port is positioned closer to the first compression stage than the second compression stage.

9. The chiller of claim 8, wherein the refrigerant conduit has a section with an increasing diameter from the first compression stage to the second compression stage, and the injection port is located before the diameter starts to increase along the refrigerant conduit.

10. The chiller of claim 8, wherein the injection port connects to a lower quarter of a cross section of the refrigerant conduit when viewing from a cross-section of the refrigerant conduit.

11. A compressor with a first compression stage and a second compression stage for a heating, ventilation, and air-conditioning (HVAC) system, comprising: a refrigerant conduit fluidly connecting the first compression stage and the second compression stage; and an injection port in fluid communication with the refrigerant conduit, wherein the fluid communication is formed closer to the first compression stage than the second compression stage, the injection port has an internal surface feature configured to direct refrigerant into a refrigerant flow direction in the refrigerant conduit, the internal surface feature has a smooth curve configured to direct refrigerant to flow in a direction similar to the refrigerant flow direction in the refrigerant conduit.

12. The compressor of claim 11, wherein the refrigerant conduit has a section of an increasing diameter from the first compression stage to the second compression stage along the refrigerant conduit, and the injection port is positioned before the section of the increasing diameter.

13. The compressor of claim 11, further comprising:

a swirl control device, wherein the swirl control device is positioned inside the refrigerant conduit between the first and the second compression stages.

14. A method of injecting refrigerant vapor between a first compression stage and a second compression stage of a compressor in a heating, ventilation, and air-conditioning (HVAC) system, comprising: directing the refrigerant vapor from an injection port toward a refrigerant conduit fluidly connecting the first compression stage and the second compression staged the injection port has an internal surface feature configured to direct refrigerant into a refrigerant flow direction in the refrigerant conduit, and the internal surface feature has a smooth curve configured to direct refrigerant to flow in a direction similar to the refrigerant flow direction in the refrigerant conduit; directing the refrigerant vapor, by use of the smooth curve of the internal surface feature, so that a flow direction of the refrigerant vapor matches a refrigerant flow direction in the refrigerant conduit; directing the refrigerant vapor into the refrigerant conduit; and mixing the refrigerant vapor with the refrigerant compressed by the first compression stage.

15. The method of claim 14, further comprising:

directing the refrigerant vapor so that a flow velocity of the refrigerant vapor matches a refrigerant flow velocity in the refrigerant conduit at the injection port.

16. The method of claim 14, further comprising:

reducing refrigerant swirling in the refrigerant conduit before the second compression stage.

* * * * *